US006705230B1

(12) United States Patent
Nichols

(10) Patent No.: US 6,705,230 B1
(45) Date of Patent: Mar. 16, 2004

(54) ACTIVE OPTICAL SIDE-LOOKING FUZE

(76) Inventor: Roy L. Nichols, 231 Locust St., Ridgecrest, CA (US) 93555

( * ) Notice: Subject to any disclaimer, the term of this patent is extended or adjusted under 35 U.S.C. 154(b) by 1,826 days.

(21) Appl. No.: 05/935,054

(22) Filed: Jul. 31, 1978

(51) Int. Cl.[7] ..... F42C 13/02
(52) U.S. Cl. ..... 102/213
(58) Field of Search ..... 102/213, 214

(56) References Cited

U.S. PATENT DOCUMENTS 3,239,674 A * 3/1966 Aroyan ..... 250/203
3,621,784 A * 11/1971 Mundie et al. ..... 102/213
3,741,111 A * 6/1973 Brenner ..... 102/213
3,786,757 A * 1/1974 Goldstein et al. ..... 102/213
3,793,958 A * 2/1974 Holt et al. ..... 102/213
3,837,283 A * 9/1974 McCrocken ..... 102/213
4,015,530 A * 4/1977 Dick ..... 102/213

FOREIGN PATENT DOCUMENTS

GB 1363072 * 8/1974 ..... 102/214

* cited by examiner

*Primary Examiner*—Charles T. Jordan

(57) ABSTRACT

An active optical fuze employing side looking, narrow beams. The beams never have anything below the roll stabilized missile in their field of view. Fog and cloud discrimination circuitry is included in the fuze. Detonation of the warhead occurs when either beam intersects any structure on the target.

11 Claims, 5 Drawing Sheets

3(b)

3(c)

3(d)

5(b)

ACTIVE OPTICAL SIDE-LOOKING FUZE

BACKGROUND OF THE INVENTION

1. Field of the Invention

This invention pertains to the field of ammunition and explosive devices. More particularly, this invention pertains to the field of fuzes, primers and igniting devices. In still greater particularity this invention pertains to an active optical fuze. By way of further characterization, but not by way of limitation thereto, the device pertains to an active optical, side looking fuze employing two narrow beams, which never have the surface below in their field of view. Fog and cloud discrimination circuitry is also included.

2. Description of the Prior Art

Optical fuzing systems exist in which optical beams are projected in a variety of directions. One system produces overlapping hollow conical fields around the circumference of the missile. Such an arrangement is shown in U.S. Pat. No. 3,793,958 issued to John G. Holt et al. on Feb. 26, 1974. That device employs logic circuitry requiring successively increasing amplitude return pulses to trigger the warhead. In addition,a threshold detector and an integrator are used wherein a constant false alarm rate is determined such that only signals greater than the mean value of noise signals are passed through the threshold detector. While satisfactory for its intended purpose such a device, if used in a surface directed missile, would require surface discrimination logic. In addition, the backscatter discriminator would be ineffectual in situations where the backscatter reflections were of extremely uneven character and exceeded the threshold sensitivity for detecting a minimum reflecting target.

Another optical fuzing system is shown in U.S. Pat. No. 3,786,757 issued to Irving Goldstein et al. on Jan. 23, 1974. This device uses a number of hollow beams paired such that the ordnance is triggered only if a signal is received first by one, then by the other of the pair of beams. Surface reflections would be received simultaneously and thus false triggering is rendered unlikely. While satisfactory for its intended purpose, such a device would be less useful in situations, such as fog or other aerosols, where the backscatter reflections are uneven and exceed the threshold sensitivity for detecting a minimum reflecting target.

For surface targets it would be highly desirable to have a fuze which is both unaffected by surface clutter and also has the capability to discriminate backscatter reflection such as that from fog or other aerosols. Such a device would be suitable for all weather use.

SUMMARY OF THE INVENTION

The invention operates as a pulsed optical radar employing narrow optical beams. In a roll stabilized missile the beams are never directed toward the surface below so that clutter discrimination logic is not needed. Detonation occurs when a beam intersects any target structure.

Fog and aerosol backscatter discrimination capability is incorporated into the fuze. A frequency selecting means in the form of a high-pass filter can be incorporated into the triggering circuitry as discrimination means. Another arrangement uses the time gain response of a sensitivity time control amplifier connected to the triggering circuitry and the detecting apparatus. Both discrimination devices operate at optimum efficiency for optical pulse widths of 10 milliseconds or less.

DESCRIPTION OF THE PREFERRED EMBODIMENT

Figure 1:
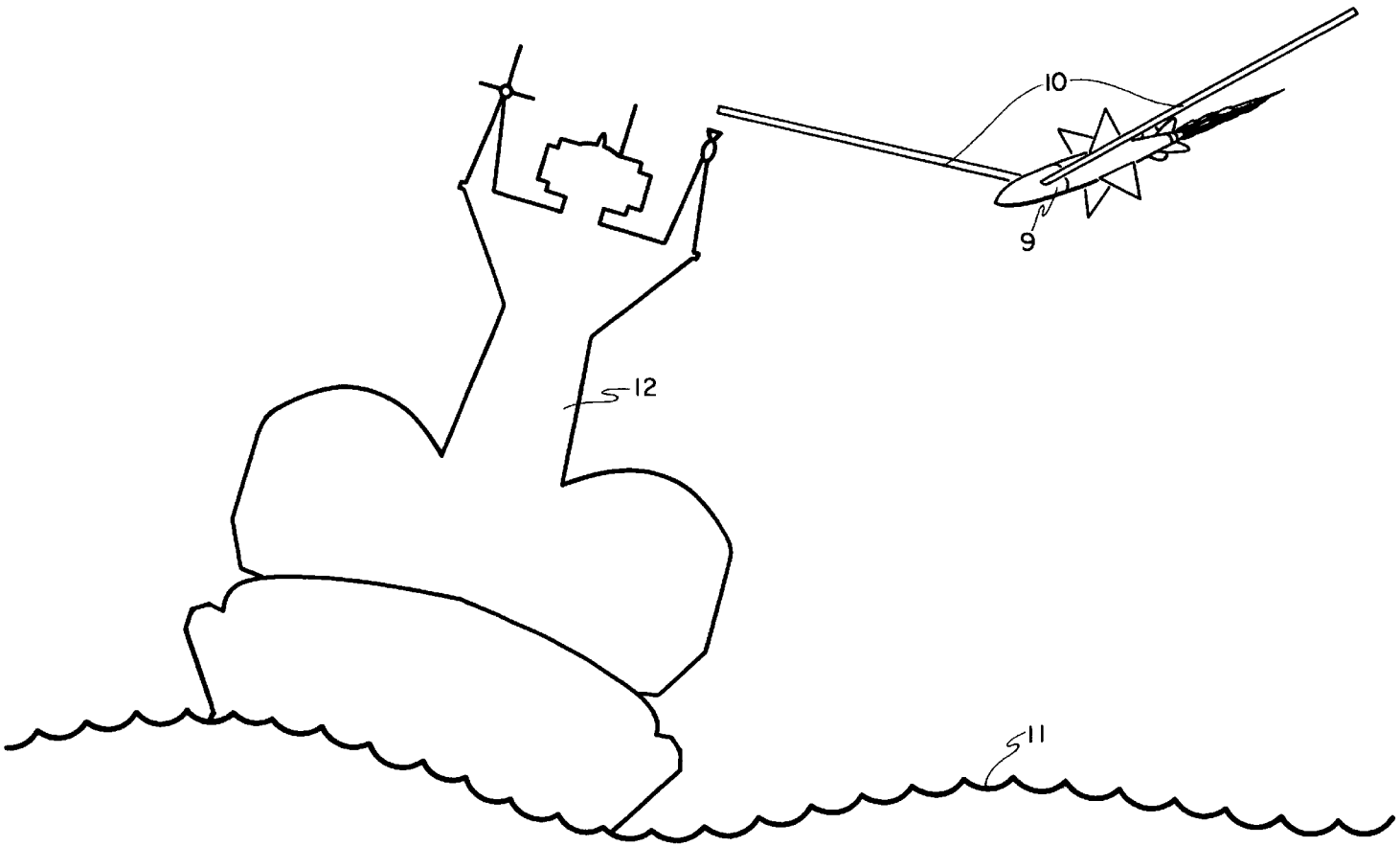
FIG. 1 shows the invention in use on a roll stabilized missile.

Referring to FIG. 1, a roll stabilized missile 9 is shown with optical beams 10 directed such that they never have surface 11 in view. Detonation of the warhead occurs when either of the beams 10 intersect any structure on a target 12.

Figure 2:
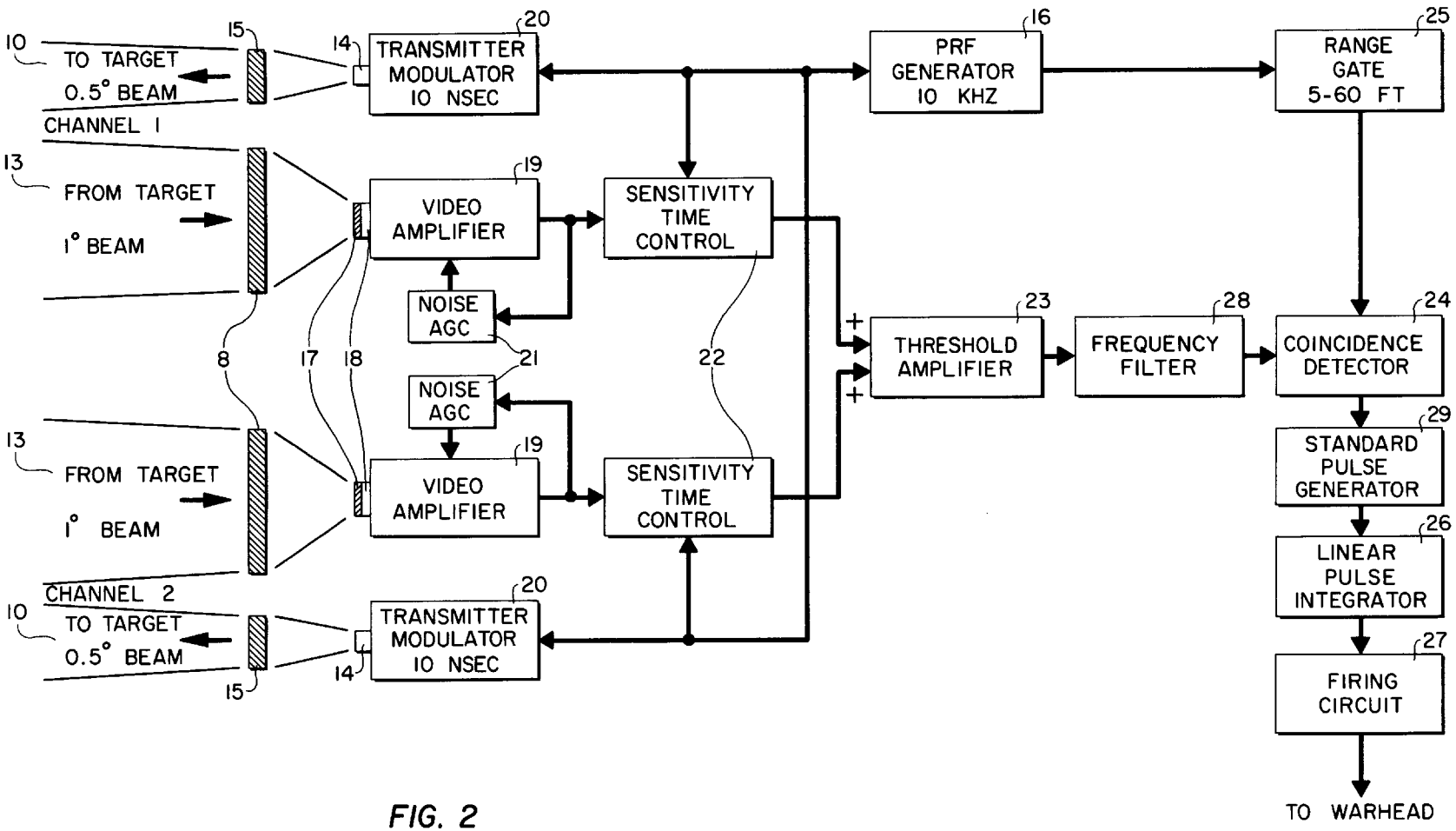
FIG. 2 is a block diagram of the invention.

A block diagram of the active optical side-looking fuze is shown in FIG. 2. The fuze has two identical channels (1 and 2). Each channel collimates the radiation from an injection laser 14 into a narrow pencil (less than 2°) transmitter beam 10 using a ½ inch simple refractive lens 15. In the instant embodiment a 0.5° beam was used. Injection laser 14 is pulsed by transmitter modulator 20 at a pulse repetition frequency determined by a PRF generator 16. A receiver beam 13 in each channel has a field-of view of 1°, using a 1.25 inch simple refractive lens 8. The receiver beam width is set at twice the transmitter beam width to alleviate the optical alignment problems in production.

A photodiode with a 1 K ohm load is used as a detector 18 in each channel. Filter 17 which may include a spectral filter and/or a polarizing filter, is mounted in front of detector 18. The signal plus noise of detector 18 is amplified in a video amplifier 19 which uses an AGC loop 21 to maintain a constant noise output at the threshold. The output of video amplifier 19 is fed into a sensitivity time control circuit 22 which provides fog discrimination.

A threshold amplifier 23, operating as a OR gate generates a constant amplitude output pulse when the output of either of sensitivity time control amplifiers 22 exceed a threshold which is set above the noise level. This occurs when either of fuze sensory beams 10 intersects a target.

The output of threshold amplifier 23 drives a time coincidence detector 24 which is keyed to targets in a predetermined range by a range gate 25. When target video pulses occur in range gate 25, coincidence detector 24 gives a constant amplitude output pulse. This output pulse triggers a standard pulse generator 29 which produces a target pulse of constant amplitude and width. Target pulses are fed into a linear pulse integrator 26 which gives an output if ten target pulses occur in 0.5 milliseconds. The output of pulse, generator 26 triggers the firing circuit 27 and fires the warhead (not shown) by conventional means.

A frequency filter 28 is connected between threshold amplifier 23 and coincidence detector 24. Frequency filter 28 is included to provide additional fog discrimination. Either sensitivity time control 22, frequency filter 28, or polarizing filter 17 or any combination thereof may be used for fog discrimination.

Mode of Operation

Referring to FIG. 1, narrow pencil beams 10 render the fuze insensitive to the size of target 12 over the range interval. Beams 10 may be pointed in a variety of directions as long as they are directed in or above a horizontal plane passing through missile 9. In the embodiment shown in FIG. 1, beams 10 are pointed slightly upward. In another embodiment, beams 10 are pointed in the horizontal plane and directed toward the aft end of the missile. The choice of direction depends upon standard engineering considerations taking into account such factors as expected trajectories, missile velocity, etc.

Referring to FIG. 2, the beam range interval is set by range gate 25. Sixty (60) feet has been found to be one suitable range setting. The optimum range for a particular application may be selected using standard engineering and design principles. Channels 1 and 2 operate independently of one another and detect the presence of target 12 when beam 10 intersects any structure on target 12 within the predetermined range.

Linear pulse integrator 26 outputs a pulse if ten target pulses occur in 0.5 milliseconds. The mean time between false alarms is therefore in excess of $10^4$ seconds. For a probability of detection of 0.99, the decision logic requires a single pulse S-N of 7 db at the output of video amplifier 19.

Because receiver beams 13 are narrow (1° in the present embodiment), the fuze is thermal noise limited and an avalanche silicon photodiode detector may be employed as photodiode 18. Use of an avalanche diode enhances the effective maximum detectable target range in fog or other backscatter situations. An alternative is to reduce the effective maximum range or increase the peak power of laser source 14. A 10 w GaAs injection laser is one suitable laser source 14 because it gives high peak power at room temperature. Different types of laser sources may be employed for different situations.

Figure 3:
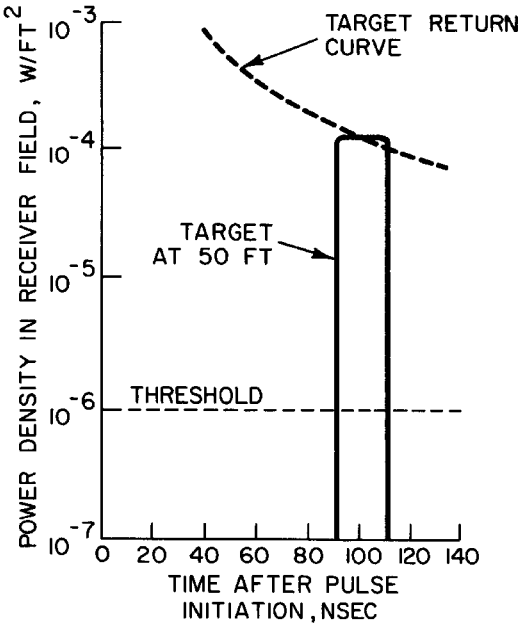
FIGS. 3–A–D are plots of the response of the laser radar fuze to a target in fogs of varying visibility.
Figure 3:
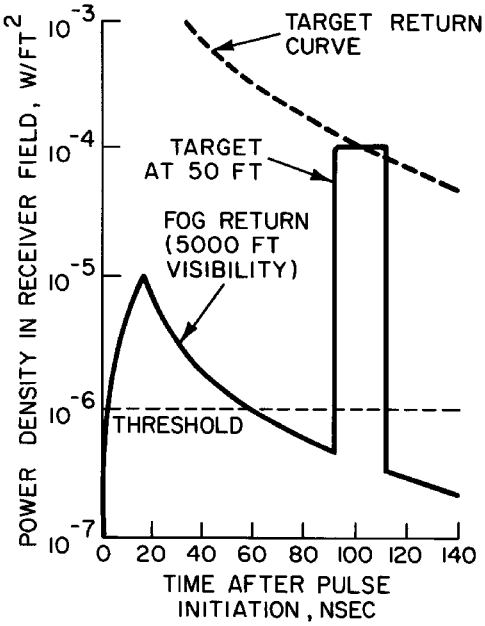
Figure 3:
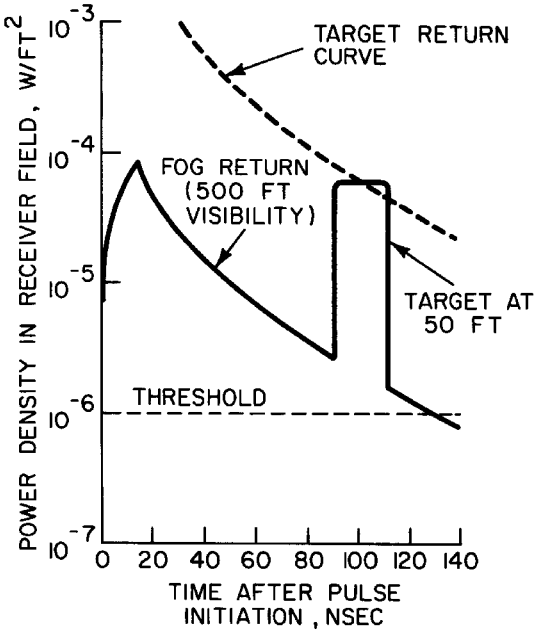
Figure 3:
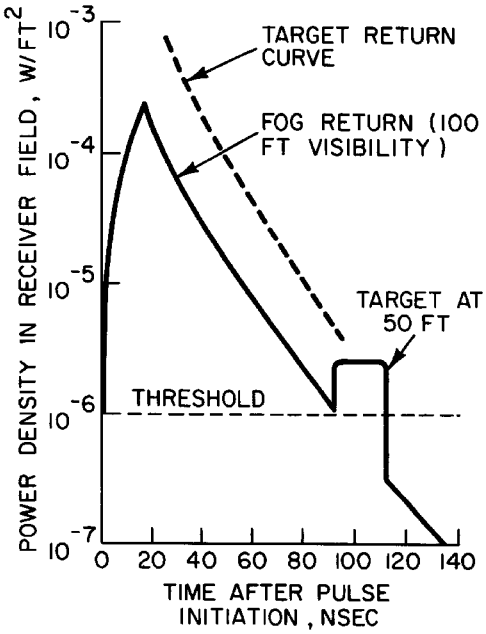

Plots of the instantaneous fog and target backscatter signal in Watts/ft$^2$ in the receiver field are displayed in FIG. 3 for clear sky and fog visibilities of 5000, 500, and 100 feet. These curves show the fog and target return in one sensory beam as a function of time after the initiation of a ten nanosecond, ten watt IR pulse with the target situated at a range of 50 feet immersed in fog of specified visibility. The sensory beam width considered was 1°. The transmitter field of view was 0.5°. The lens efficiency was 0.5. The dotted target return curve corresponds to the peak target return signal at a given round trip time delay after pulse initiation for a 0.2 reflectivity target. The return signal from a target at 50 feet is centered at 100 nanoseconds from time zero. The leading edge of the transmitted pulse is time zero. The peak fog return occurs approximately 15 nanoseconds after pulse initiation or, equivalently, at a range of 7.5 feet.

FIGS. 3*a–d* illustrate that the target return pulse is always greater than the fog signal over the time interval wherein the target return signal occurs. The fog back-scatter signal has a peak return greater than the target return during the time interval before the target return pulse arrives in fog with visible ranges less than 500feet. Therefore, no single threshold, such as is indicated by the horizontal dotted line in FIGS. 3*a–d*, would be satisfactory as protection against fog.

Figure 4:
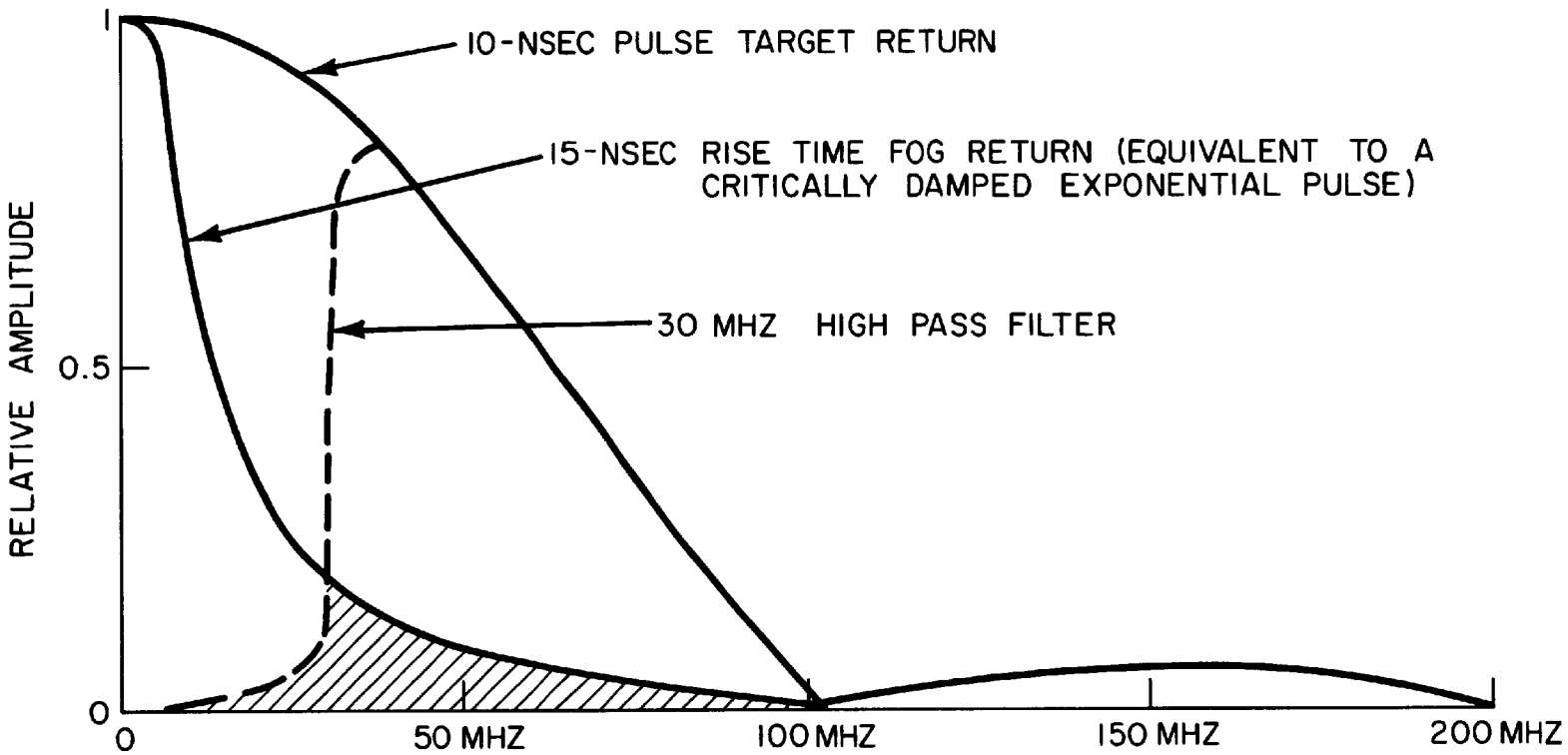
FIG. 4 is a plot of the frequency spectrum of the laser radar fuze return in fog.

In FIGS. 3*a–d* the fog signal rises exponentially in approximately 15 nanoseconds, then decays exponentially. The fog signal behaves like a critically damped exponential wave form with a time constant of 15 nanoseconds. Because of this characteristic a matched filter, incorporated into the fuze design, would reduce the fog return magnitude with respect to the target return. FIG. 4 shows a plot of the normalized frequency spectrum for the 15 nanosecond rise time fog return and a 10 nanosecond target return pulse.

Referring again to FIG. 2, some fog suppression may be obtained from a frequency filter 28 inserted between the detector 24 and the video amplifier 19. The effect of frequency filter 28, which may be a high pass filter, is shown in FIG. 4 and is based on a target return pulse being always greater than the fog return signal over the time interval when the target signal occurrs. Consequently, fog discrimination can be provided by decreasing the receiver sensitivity for near range signal return.

Referring again to FIG. 3, it is discerned that the peak target return signal is always greater than the fog return signal over the interval wherein the target signal occurs. Therefore, some form of receiver sensitivity versus time control could be incorporated into the fuze to suppress the early peak fog return. This fog discrimination scheme is illustrated in FIG. 5.

Figure 5A:
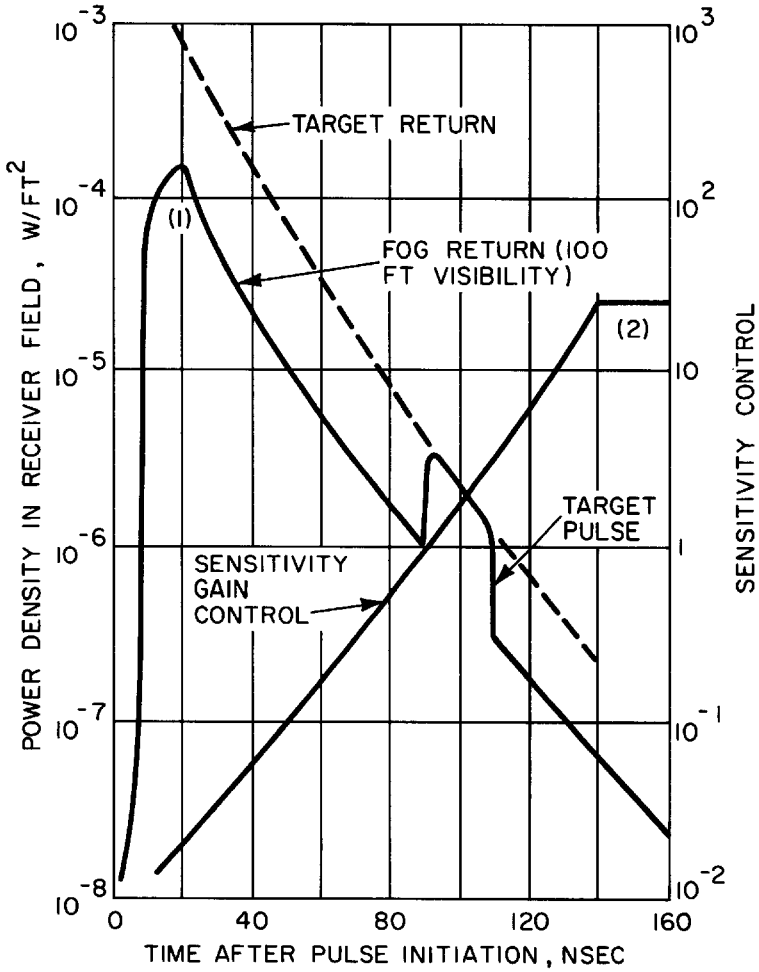
FIGS. 5A and B are plots showing the effect of sensitivity time control for 100 foot visibility fog.
Figure 5A:
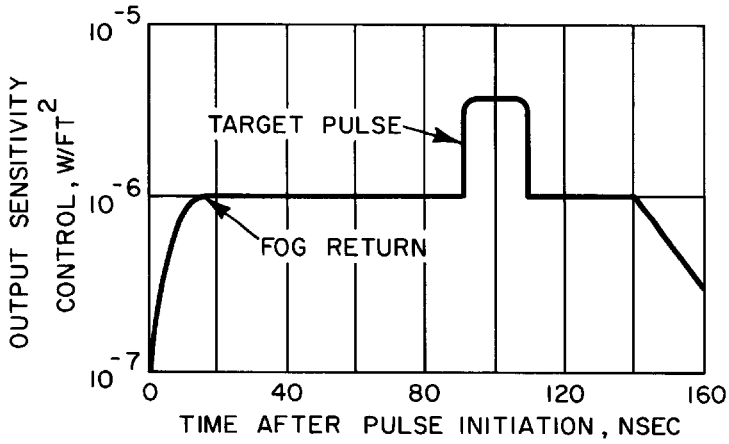

FIG. 5A is a duplication of the 100 foot visibility fog return shown in FIG. 3*d*. Superimposed on this plot is a sensitivity gain control curve which would be the time gain response of the sensitivity time control amplifier (22 in FIG. 2). The instantaneous time product of curves 1 and 2 in FIG. 5*a* is plotted in FIG. 5*b*. Referring to FIG. 5*b*, the early fog return may be suppressed by having a single threshold at the sensitivity time control amplifier output above $10^{-6}$ Watts/ft$^2$. This threshold gives fog protection over the 60 foot range interval for pulse widths of 10 nanoseconds or less.

The foregoing description, taken together with the appended claims, constitutes a disclosure such as to enable a person skilled in the electronic and mechanical engineering arts and having the benefit of the teachings contained therein to make and use the invention. Further, the structure herein described constitutes a meritorious advance in the art which is unobvious to such skilled workers not having the benefit of these teachings.

What is claimed is:

1. A fuze for use in a roll stabilized missile said fuze having an optical transmitter for establishing an optical energy path extending outward from said missile, an optical receiver for recovering optical energy reflected from said optical energy path, and triggering circuitry connected to said optical receiver, wherein the improvement comprises:

directing means, located in said transmitted optical energy path, for conducting the optical energy in a predetermined direction; and background discrimination means, operatively connected to said optical receiver and said triggering circuitry, for selecting target reflected optical energy originating in said transmitted optical energy path from all the optical energy incident on said receiver.

2. A fuze according to claim 1 where in said directing means includes refracting means for expanding said optical energy into a predetermined beam width.

3. A fuze according to claim 1 wherein said predetermined direction is in or above a horizontal plane passing through the length of said roll stabilized missile.

4. A fuze according to claim 3 wherein said predetermined direction is toward the rear of said missile.

5. A fuze according to claim 2 wherein said refracting means is a simple refractive lens.

6. A fuze according to claim 1 wherein said background discrimination means includes sensitivity time control circuitry.

7. A fuze according to claim 6 wherein said sensitivity time control circuitry includes a sensitivity time control amplifier.

8. A fuze according to claim 1 wherein said background discrimination means includes frequency selecting means for allowing energy waves of a predetermined frequency to pass therethrough.

9. A fuze according to claim 8 wherein said frequency selecting means includes a high pass filter.

10. A fuze according to claim 1 wherein said background discrimination means includes a polarizing filter.

11. A fuze according to claim 2 wherein said predetermined beam width is less than or equal to 2 degrees.

* * * * *

UNITED STATES PATENT AND TRADEMARK OFFICE

CERTIFICATE OF CORRECTION

PATENT NO. : 6,705,230 B1
DATED : March 16, 2004
INVENTOR(S) : Nichols, Roy L.

It is certified that error appears in the above-identified patent and that said Letters Patent is hereby corrected as shown below:

Title page,
Item [74], *Attorney, Agent, or Firm*, add -- David S. Kalmbaugh --

Signed and Sealed this

Eighth Day of June, 2004

JON W. DUDAS
*Acting Director of the United States Patent and Trademark Office*